US006651898B2

(12) United States Patent
Nowotny et al.

(10) Patent No.: US 6,651,898 B2
(45) Date of Patent: Nov. 25, 2003

(54) METHOD AND DEVICE FOR ATOMIZING LIQUIDS

(75) Inventors: Markus Nowotny, Stein (CH); Guido Schaer, Baettwil (CH)

(73) Assignee: Roche Vitamins Inc., Parsippany, NJ (US)

( * ) Notice: Subject to any disclaimer, the term of this patent is extended or adjusted under 35 U.S.C. 154(b) by 142 days.

(21) Appl. No.: 09/944,335

(22) Filed: Aug. 31, 2001

(65) Prior Publication Data

US 2002/0043571 A1 Apr. 18, 2002

(30) Foreign Application Priority Data

Sep. 5, 2000 (EP) ..... 00810800

(51) Int. Cl.[7] ..... B05B 17/04

(52) U.S. Cl. ..... 239/7; 239/222; 239/223; 239/246; 239/263.1; 239/556

(58) Field of Search ..... 239/7, 222, 223, 239/225.1, 246, 248, 263.1, 418, 423, 433, 380, 548, 556, 557, 558; 264/5, 8; 425/6, 8; 75/330, 333; 261/115–118, 78.1; 134/167 R

(56) References Cited

U.S. PATENT DOCUMENTS 2,954,038 A * 9/1960 Girard ..... 134/167 R
2,986,338 A * 5/1961 Foster ..... 239/222
3,241,948 A 3/1966 Claiborne et al.
3,900,164 A 8/1975 Friestad
4,030,513 A * 6/1977 McKenzie ..... 134/167 R
4,218,409 A * 8/1980 Dannelly ..... 264/8
4,221,332 A * 9/1980 Bals ..... 239/223
4,407,217 A * 10/1983 Jackson ..... 239/223
5,752,657 A * 5/1998 Hogan et al. ..... 239/7

OTHER PUBLICATIONS

Schmidt, "Auslegung rotierender poröser Zerstäubungskörper," *Verfahrenstechnik*, vol. 8, No. 7, pp. 209–212 (1974).

* cited by examiner

*Primary Examiner*—Steven J. Ganey
(74) *Attorney, Agent, or Firm*—Bryan Cave LLP

(57) ABSTRACT

The present invention is a device for atomizing liquids which has:

a) a rotatable apparatus for the reception of liquids to be atomized, the apparatus is defined by a cylinder having an interior chamber that runs the length of the cylinder with an internal diameter of about 10 to about 25 millimeters, the cylinder has an upper end with an opening into the interior chamber, which opening is adapted to receive liquids to be atomized, the cylinder has a closed lower end that terminates with a floor, the outer surface of the cylinder is defined by an outer casing having a plurality of circular hole-type nozzles extending up about 20 to about 120 millimeters from the lower end of the cylinder in an axial direction, the hole-type nozzles are in fluid communication with the interior chamber for introducing the liquid to be atomized into the nozzles; and b) a drive operably connected to the cylinder for rotating the hollow cylinder. A method of spray cooling a liquid using the device of the invention, and a method of producing powders from solutions, dispersions, emulsions, or melts are also provided.

47 Claims, 6 Drawing Sheets

METHOD AND DEVICE FOR ATOMIZING LIQUIDS

FIELD OF THE INVENTION

The present invention relates to a device for atomizing liquids. The invention also relates to a method for atomizing, spray cooling, and spray drying of liquids. The invention further relates to a method for producing powders from solutions, dispersions, or melts, preferably from emulsions.

BACKGROUND OF THE INVENTION

P. Schmid "Auslegung rotierender poröser Zerstäubungskorper," Verfahrenstechnik 8 (1974) No. 7 provides a basic description of the utilization of a hollow cylinder with a plurality of circular hole-type nozzles.

SUMMARY OF THE INVENTION

One object of the present invention is to provide a device for atomizing liquids.

Another object of the present invention is to provide a method for atomizing, spray cooling, and spray drying of liquids.

A further object of the present invention is a method for producing powders from solutions, dispersions, or melts, preferably from emulsions.

One embodiment of the present invention is a device for atomizing liquids which has:

a) a rotatable apparatus for the reception of liquids to be atomized, the apparatus is defined by a cylinder having an interior chamber that runs the length of the cylinder with an internal diameter of about 10 to about 25 millimeters, the cylinder has an upper end with an opening into the interior chamber, which opening is adapted to receive liquids to be atomized, the cylinder has a closed lower end that terminates with a floor, the outer surface of the cylinder is defined by an outer casing having a plurality of circular hole-type nozzles extending up about 20 to about 120 millimeters from the lower end of the cylinder in an axial direction, the hole-type nozzles are in fluid communication with the interior chamber for introducing the liquid to be atomized into the nozzles; and b) a drive operably connected to the cylinder for rotating the hollow cylinder.

Another embodiment of the present invention is a device for the atomizing liquids which has:

a) a rotatable apparatus for the reception of liquids to be atomized, the apparatus is defined by a cylinder having an interior chamber that runs the length of the cylinder, the cylinder has an upper end with an opening into the interior chamber, which opening is adapted to receive liquids to be atomized, the cylinder has a closed lower end that terminates with a floor, the outer surface of the cylinder is defined by an outer casing having a plurality of circular hole-type nozzles, the hole-type nozzles are in fluid communication with the interior chamber introducing the liquid to be atomized into the nozzles;

b) a feed conduit having an outer side wall surface and an inner conduit surface, the feed conduit adapted to be disposed within the interior chamber of the cylinder along an axis of rotation of the cylinder, the feed conduit having (a) an upper end with an inlet through which liquids to be atomized are introduced into the interior chamber of the cylinder, the inlet being attached to the opening of the hollow cylinder and thereby to the source of the liquid to be atomized, and (b) a lower end with an outlet for the atomized liquid wherein the inlet and the outlet are in fluid communication, the lower end of the feed conduit disposed within the interior chamber such that the distance between the outlet and the interior chamber floor is less than the distance between the outlet and the opening to the interior chamber; and c) a drive operably connected to the cylinder for rotating the hollow cylinder.

It is another object of the present invention to provide a device of the type set forth above with which technically desirable throughputs during the process of atomizing liquids can be obtained and which thereby should operate with low wear. The structure and the dimensions of the hollow cylinder and of the circular hole-type nozzles in its casing are selected in such a way that a uniform distribution of the liquid and its temperature in the aforementioned circular hole-type nozzles is obtained and that the circular hole-type nozzles have a negligible tendency to get clogged. Furthermore, the hollow cylinder of the present invention is easy to mount and dismount and the cleaning of the hollow cylinder as well as of the circular hole-type nozzles is easy.

A further embodiment of the present invention is a method for spray cooling or spray drying of a liquid having the following steps:

a) introducing the liquid into a device which has:

i) a rotatable apparatus for the reception of liquids to be atomized, the apparatus is defined by a cylinder having an interior chamber that runs the length of the cylinder with an internal diameter of about 10 to about 25 millimeters, the cylinder has an upper end with an opening into the interior chamber, which opening is adapted to receive liquids to be atomized, the cylinder has a closed lower end that terminates with a floor, the outer surface of the cylinder is defined by an outer casing having a plurality of circular hole-type nozzles extending up about 20 to about 120 millimeters from the lower end of the cylinder in an axial direction, the hole-type nozzles are in fluid communication with the interior chamber for introducing the liquid to be atomized into the nozzles and ii) a drive operably connected to the cylinder for rotating the hollow cylinder; and b) spraying the liquid through the nozzles by rotating the cylinder and causing the liquid to be atomized.

Another embodiment of the present invention is a method for spray cooling or spray drying of a liquid having the following steps:

a) introducing the liquid into a device which has:

i) a rotatable apparatus for the reception of liquids to be atomized, the apparatus is defined by a cylinder having an interior chamber that runs the length of the cylinder, the cylinder has an upper end with an opening into the interior chamber, which opening is adapted to receive liquids to be atomized, the cylinder has a closed lower end that terminates with a floor, the outer surface of the cylinder is defined by an outer casing having a plurality of circular hole-type nozzles, the hole-type nozzles are in fluid communication with the interior chamber for introducing the liquid to be atomized into the nozzles, ii) a feed conduit having an outer side wall surface and an inner conduit surface, the feed conduit adapted to be disposed within the interior chamber of the cylinder along an axis of rotation of the cylinder, the feed conduit having (a) an upper end with an inlet through which liquids to be atomized are introduced into the interior chamber of the cylinder, the inlet being attached to the opening of the hollow cylinder and thereby to the source of the liquid to be atomized, and (b) a lower end with an outlet for the atomized liquid wherein the inlet and the outlet are in fluid communication, the lower end of the feed conduit disposed within the interior chamber such that the distance between the outlet and the interior chamber floor is less than the distance between the outlet and the opening to the interior chamber, and iii) a drive operably connected to the cylinder for rotating the hollow cylinder; and b) spraying the liquid through the nozzles by rotating the cylinder and causing the liquid to be atomized.

A further embodiment of the present invention is a method of producing powders from solutions, dispersions, emulsions, or melts having the following steps:

a) introducing a solution, dispersion, emulsion, or melt into a device which has:

i) a rotatable apparatus for the reception of liquids to be atomized, the apparatus is defined by a cylinder having an interior chamber that runs the length of the cylinder with an internal diameter of about 10 to about 25 millimeters, the cylinder has an upper end with an opening into the interior chamber, which opening is adapted to receive liquids to be atomized, the cylinder has a closed lower end that terminates with a floor, the outer surface of the cylinder is defined by an outer casing having a plurality of circular hole-type nozzles extending up about 20 to about 120 millimeters from the lower end of the cylinder in an axial direction, the hole-type nozzles are in fluid communication with the interior chamber for introducing the liquid to be atomized into the nozzles and ii) a drive operably connected to the cylinder for rotating the hollow cylinder; and b) rotating the cylinder to atomize the solution, dispersion, emulsion, or melt.

DETAILED DESCRIPTION OF THE INVENTION

Figure 1:
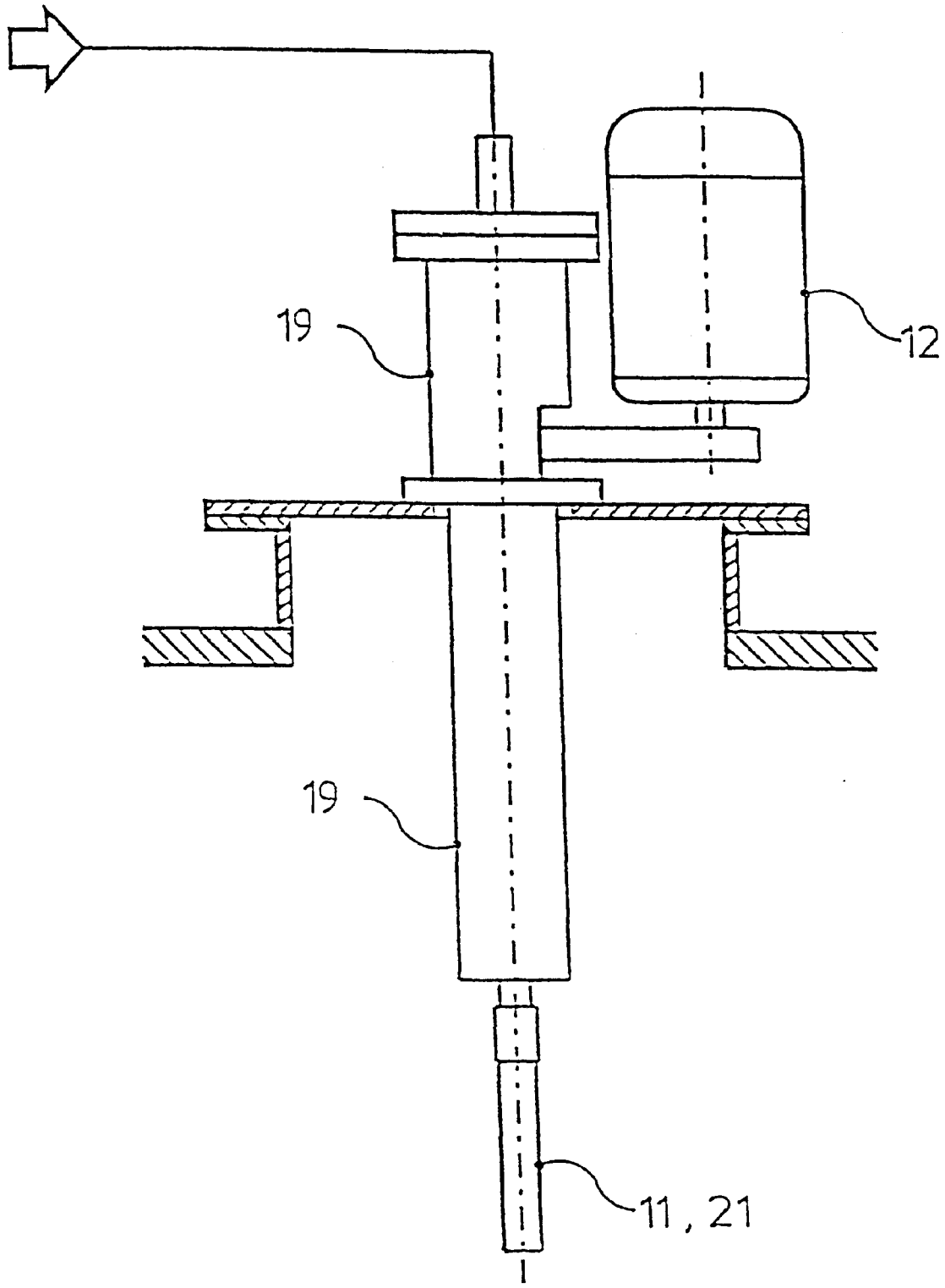
FIG. 1 shows a device in accordance with the present invention for atomizing liquids. In the device, a hollow cylinder in accordance with FIG. 2 or an arrangement of a hollow cylinder 21 with a feed conduit 31 in accordance with FIG. 9 can be used.

Using a device of the present invention, a narrow droplet size distribution to be achieved, whereby the average droplet size during the spraying is in a range of from about 50 to about 500 micrometers, preferably in a range from about 100 to about 350 micrometers.

As used herein, the term "liquid" includes solutions, especially aqueous solutions, dispersions, and emulsions of active substances as well as melts, e.g., fat melts, optionally containing active substances. Examples of active substances are fat-soluble vitamins, such as, e.g., vitamins A, E, D, or K, carotenoids, such as, e.g., β-carotene, zeaxanthin, lutein, or astaxanthin, fat- or water-soluble pharmaceutically active substances, as well as water-soluble vitamins, such as, e.g., vitamin C and the B vitamins.

One embodiment of the present invention is a device for atomizing liquids, which device has:

a) a rotatable apparatus for the reception of liquids to be atomized, the apparatus is defined by a cylinder having an interior chamber that runs the length of the cylinder with an internal diameter of about 10 to about 25 millimeters, the cylinder has an upper end with an opening into the interior chamber, which opening is adapted to receive liquids to be atomized, the cylinder has a closed lower end that terminates with a floor, the outer surface of the cylinder is defined by an outer casing or wall having a plurality of circular hole-type nozzles extending up about 20 to about 120 millimeters from the lower end of the cylinder in an axial direction, the hole-type nozzles are in fluid communication with the interior chamber for introduction of liquids to be atomized; and b) a drive operably connected to the cylinder for rotating the hollow cylinder.

The device according to the present invention:

Facilitates the generation of a laminar thread-like disintegration of the liquid to be atomized thereby achieving a narrow droplet size distribution, with the average droplet size during the spraying being in a range of 50 to 500 micrometers, preferably in a range of 100 to 350 micrometers;

Has a very compact construction of the device for atomizing liquids due to a very simple structure, relatively small dimensions and the low weight of the hollow cylinder;

Produces a uniform distribution of the liquid and its temperature in the hollow cylinder and in the circular hole-type nozzles in the cylinder casing, by which means obstruction by drying or gelling processes and thereby clogging of the circular hole-type nozzles is prevented;

Has a very low-wear operation that is achieved by the relatively low flow velocities in the borings of the circular hole-type nozzles of the hollow cylinder;

Uses considerably less energy for the rotation drive of the hollow cylinder compared to the energy required by conventional atomizing devices; and Is optimally suitable for relatively small liquid throughputs.

In a preferred embodiment, the hollow cylinder is detachably mounted, preferably screw-mounted on a co-rotating hollow shaft which serves to feed the liquid to be atomized into the hollow cylinder. The hollow cylinder can therefore be mounted and dismounted from the device with little effort, which reduces the expenditure of time for maintenance procedures. By this means and by the very simple structure as well as the low wall thickness of the hollow cylinder, the hollow cylinder as well as the circular hole-type nozzles are easy to clean.

Another embodiment of the present invention is a device for atomizing liquids, which device has:

a) a rotatable apparatus for the reception of liquids to be atomized, the apparatus is defined by a cylinder having an interior chamber that runs the length of the cylinder, the cylinder has an upper end with an opening into the interior chamber, which opening is adapted to receive liquids to be atomized, the cylinder has a closed lower end that terminates with a floor, the outer surface of the cylinder is defined by an outer casing having a plurality of circular hole-type nozzles, the hole-type nozzles are in fluid communication with the interior chamber for introduction of liquids to be atomized;

b) a feed conduit having an outer side wall surface and an inner conduit surface, the feed conduit adapted to be disposed within the interior chamber of the cylinder along an axis of rotation of the cylinder, the feed conduit having (a) an upper end with an inlet through which liquids to be atomized are introduced into the interior chamber of the cylinder, the inlet being attached to the opening of the hollow cylinder and thereby to the source of the liquid to be atomized, and (b) a lower end with an outlet for the atomized liquid wherein the inlet and the outlet are in fluid communication, the lower end of the feed conduit disposed within the interior chamber such that the distance between the outlet and the interior chamber floor is less than the distance between the outlet and the opening to the interior chamber; and c) a drive operably connected to the cylinder for rotating the hollow cylinder.

Using a feed conduit in the present device, a uniform distribution of the liquid and its temperature in the hollow cylinder and a uniform distribution of the liquid in the circular hole-type nozzles of the hollow cylinder's casing are advantageously achieved despite the optionally larger dimensions of the hollow cylinder.

A further embodiment of the present invention is a method for spray cooling or spray drying of a liquid having the following steps:

a) introducing the liquid into a device which has:

i) a rotatable apparatus for the reception of liquids to be atomized, the apparatus is defined by a cylinder having an interior chamber that runs the length of the cylinder with an internal diameter of about 10 to about 25 millimeters, the cylinder has an upper end with an opening into the interior chamber, which opening is adapted to receive liquids to be atomized, the cylinder has a closed lower end that terminates with a floor, the outer surface of the cylinder is defined by an outer casing having a plurality of circular hole-type nozzles extending up about 20 to about 120 millimeters from the lower end of the cylinder in an axial direction, the hole-type nozzles are in fluid communication with the interior chamber for introduction of liquids to be atomized and ii) a drive operably connected to the cylinder for rotating the hollow cylinder; and b) spraying the liquid through the nozzles by rotating the cylinder and causing the liquid to be atomized.

Another embodiment of the present invention is a method for spray cooling or spray drying of a liquid having the following steps:

a) introducing the liquid into a device which has:

i) a rotatable apparatus for the reception of liquids to be atomized, the apparatus is defined by a cylinder having an interior chamber that runs the length of the cylinder, the cylinder has an upper end with an opening into the interior chamber, which opening is adapted to receive liquids to be atomized, the cylinder has a closed lower end that terminates with a floor, the outer surface of the cylinder is defined by an outer casing having a plurality of circular hole-type nozzles, the hole-type nozzles are in fluid communication with the interior chamber for introduction of liquids to be atomized, ii) a feed conduit having an outer side wall surface and an inner conduit surface, the feed conduit adapted to be disposed within the interior chamber of the cylinder along an axis of rotation of the cylinder, the feed conduit having (a) an upper end with an inlet through which liquids to be atomized are introduced into the interior chamber of the cylinder, the inlet being attached to the opening of the hollow cylinder and thereby to the source of the liquid to be atomized, and (b) a lower end with an outlet for the atomized liquid wherein the inlet and the outlet are in fluid communication, the lower end of the feed conduit disposed within the interior chamber such that the distance between the outlet and the interior chamber floor is less than the distance between the outlet and the opening to the interior chamber, and iii) a drive operably connected to the cylinder for rotating the hollow cylinder, and b) spraying the liquid through the nozzles by rotating the cylinder and causing the liquid to be atomized.

A further embodiment of the present invention is a method of producing powders from solutions, dispersions, emulsions, or melts using any of the devices set forth above.

As shown in FIG. 1, the device in accordance with the present invention has the following components:

a) a rotatable hollow cylinder 11 or 21 for the reception of the liquid to be atomized;

b) a drive 12, preferably electromechanical, for the rotation of the hollow cylinder 11 or 21; and c) means by which the liquid to be atomized is introduced into the hollow cylinder 11 or 21 under a certain pressure. This pressure is, e.g., between about 0.3 and about 5 bar.

The last-mentioned means may be, e.g., a co-rotating hollow shaft 19 which is also rotatable from drive 12 and which, in turn, is connected, e.g., via a pump with a source of the liquid to be atomized to the hollow cylinder 11 or 21.

The hollow cylinder 11 or 21 can be manufactured from all materials which can be mechanically processed for the purpose described here, e.g., from a metal, such as steel or steel alloy, or a plastic, such as polyvinyl chloride or polyethylene.

The drive 12 is mechanically connected to the hollow cylinder 11 and allows it to be rotated at a speed of rotation in a range of from about 2,000 to about 20,000 revolutions per minute, preferably from about 3,000 to about 10,000 revolutions per minute.

Figure 2:
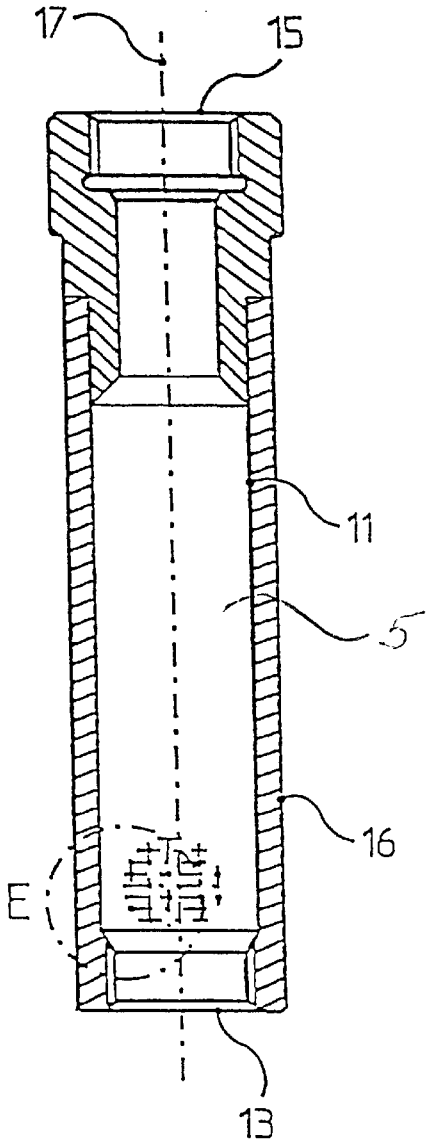
FIG. 2 shows a schematic representation of a cross-section of a first embodiment of the hollow cylinder 11.
Figure 4:
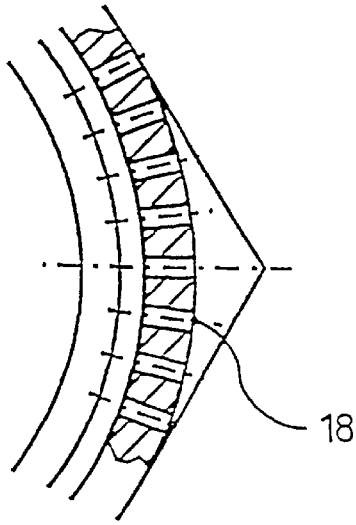
FIG. 4 shows an enlarged representation of a small part of a cross-section of the cylinder casing 16 in FIG. 2.
Figure 3:
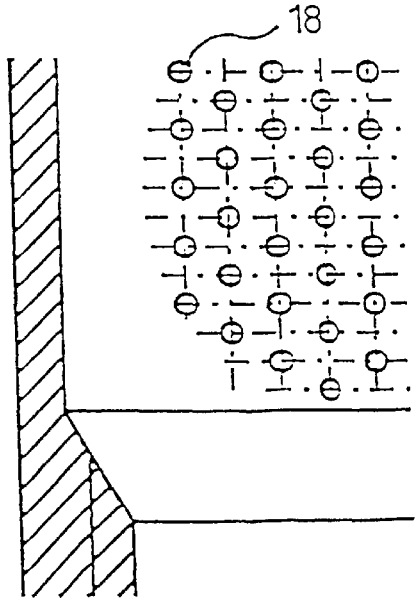
FIG. 3 shows an enlarged representation of a side view of segment E in FIG. 2.

A first embodiment of a device in accordance with the present invention has the basic structure in accordance with FIG. 1 described above and contains a hollow cylinder 11 in accordance with FIGS. 2–4.

As will be evident from FIG. 2, the hollow cylinder 11 is closed at its bottom end with a floor 13 and has an opening 15 at its upper end. The hollow part of the cylinder defines an interior chamber 5. As shown in detail in FIGS. 3 and 4, the outer surface of the hollow cylinder 11 defines an axis of rotation 17 and a long cylindrical casing 16 with a plurality of circular hole-type nozzles 18 for the introduction of the liquid to be atomized.

The hollow cylinder 11 is removably attached at its upper end to a co-rotating hollow shaft 19 (FIG. 1) through which liquid can be introduced into the hollow cylinder 11 through the opening 15. Preferably, the hollow cylinder 11 is screwed on to the co-rotating hollow shaft 19. This has the advantage that the hollow cylinder 11 can be mounted and dismounted without special tools. Alternatively, the hollow cylinder 11 may be attached by snap-fitting device, by a pressure fit, or any other conventional means for detachably mounting the hollow cylinder 11 to the co-rotating hollow shaft 19. The hollow cylinder 11 has an internal diameter of from about 10 to about 25 millimeters internal diameter.

The surface of the cylinder casing 16 carrying the circular hole-type nozzles 18, extends in the axial direction of the hollow cylinder 11 over a length between about 20 and about 120 millimeters as measured up from the lower end of the hollow cylinder 11.

Each of the circular hole-type nozzles 18 in the casing 16 of the hollow cylinder 11 has a hole diameter from about 0.05 to about 1 millimeter, preferably in the range of from about 0.1 to about 0.4 millimeter. Each of the circular hole-type nozzles 18 in the casing 16 of the hollow cylinder 11 has a length/hole diameter ratio which is in a range of from about 1 to about 50, preferably from about 2 to about 10.

With the above-described construction of the hollow cylinder 11, a laminar thread-like disintegration and therewith a narrow droplet size distribution upon droplet dispersion is achieved by suitable choice of the viscosity of the liquid to be atomized, the throughput of the liquid to be atomized, the rotation speed, and the diameter of the hollow cylinder 11. The average droplet size during the spraying is in the range of from about 50 to about 500 micrometers, preferably from about 100 to about 350 micrometers.

Another embodiment of the device according to the present invention has the basic structure in accordance with FIG. 1 described above, but contains in place of the hollow cylinder 11 in accordance with FIGS. 1–3 an arrangement in accordance with FIGS. 5–9, which arrangement contains a rotatable hollow cylinder 21 for the reception of the liquid to be atomized and a feed conduit 31 which is rotatable with the hollow cylinder 21 and through which the liquid to be atomized can be introduced into the hollow cylinder 21.

Figure 5:
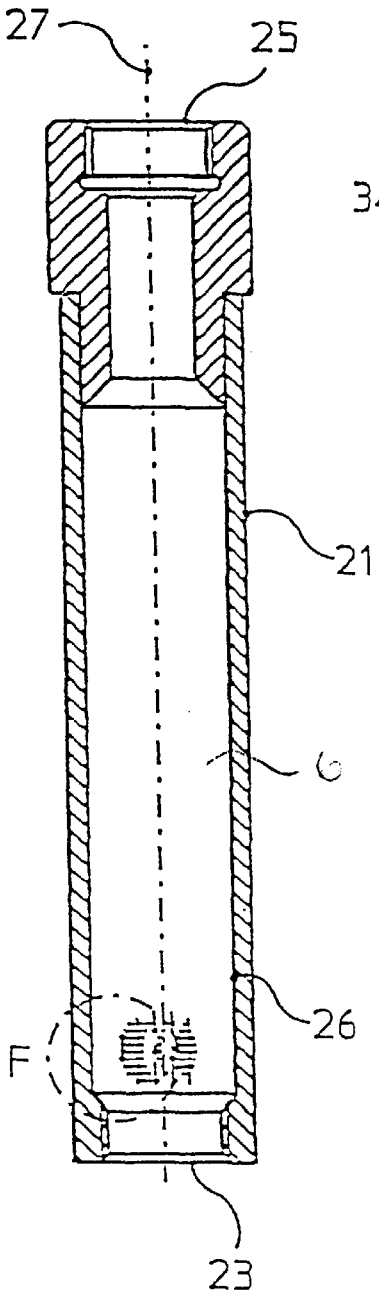
FIG. 5 shows a schematic representation of a cross-section of a second embodiment of the hollow cylinder 21.
Figure 8:
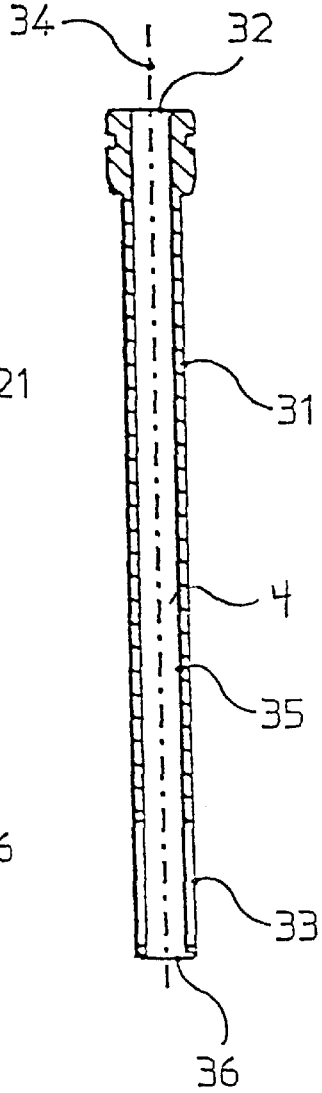
FIG. 8 shows a cross-section of a feed conduit 31 which is used in the hollow cylinder 21 in accordance with FIG. 5.
Figure 7:
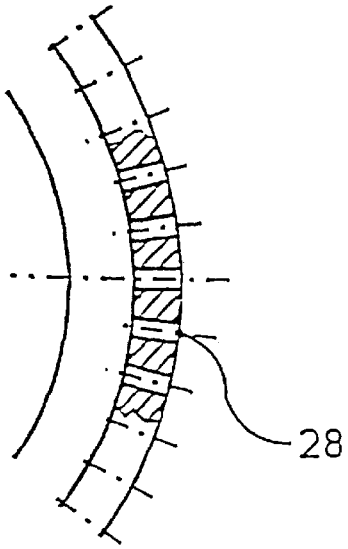
FIG. 7 shows an enlarged representation of a small part of a cross-section of the wall 26 in FIG. 5.
Figure 6:
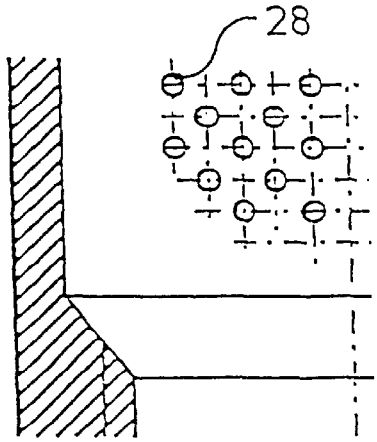
FIG. 6 shows an enlarged representation of a side view of segment F in FIG. 5.
Figure 9:
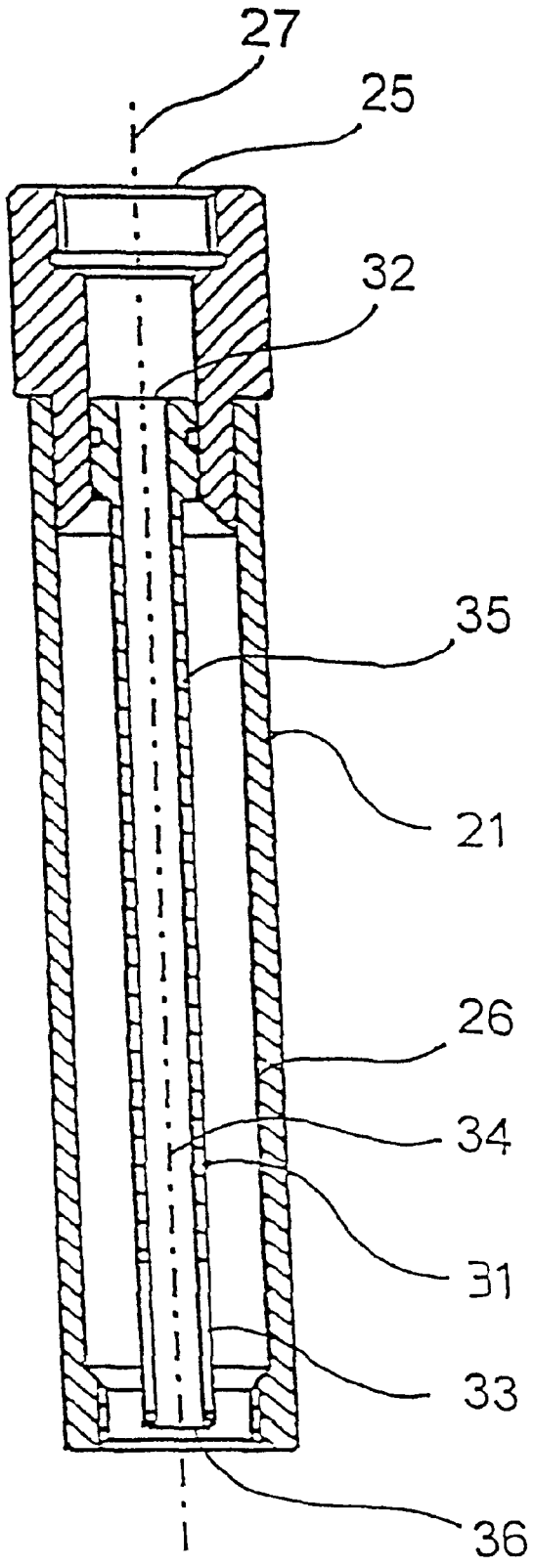
FIG. 9 shows a cross-section of the hollow cylinder 21 in accordance with FIG. 5 with a feed conduit 31 inserted therein.

As will be evident from FIG. 5, the hollow cylinder 21 is closed at its bottom end with a floor 23 and has an opening 25 at its upper end. As shown in detail in FIGS. 6 and 7, the casing 26 of the hollow cylinder 11 has a plurality of circular hole-type nozzles 28 for the introduction of the liquid to be atomized.

The hollow cylinder 21 is removably attached at its upper end to a co-rotating hollow shaft 19 (FIG. 1) through which liquid is introduced into the hollow cylinder 21 through the opening 25. Preferably, the hollow cylinder 21 is screw-mounted on the co-rotating hollow shaft 19 (FIG. 1). This has the advantage that the hollow cylinder 21 can be mounted and dismounted without special tools. The hollow cylinder 21 has an internal diameter in the range of from about 10 to about 60 millimeters, preferably from about 20 to about 40 millimeters.

The surface of the cylinder casing 26, which carries the circular hole-type nozzles 28, extends up from the lower end of the cylinder in the axial direction over a length of the cylinder from about 120 to about 400 millimeters, preferably from about 120 to about 250 millimeters.

Each of the circular hole-type nozzles 28 in the casing 26 of the hollow cylinder 21 has a hole diameter which is in the range of from about 0.05 to about 1 millimeter, preferably from about 0.1 to about 0.4 millimeter. Each of the circular hole-type nozzles 28 in the casing 26 of the hollow cylinder 21 has a length/hole diameter ratio in the range of from about 1 to about 50, preferably from about 2 to about 10.

The feed conduit 31 is disposed within the cylinder 21 such that the longitudinal axis 34 of the feed conduit 31 coincides with the axis of rotation 27 of the hollow cylinder 21.

The inlet 32 of the feed conduit 31 is attached to the opening 25 of the hollow cylinder 21 and thereby to the source of the liquid to be atomized.

The outlet 33 of the feed conduit 31 is positioned in the interior chamber 6 of the hollow cylinder 21 and at its end region above where the floor of the hollow cylinder is located.

The outlet 33 of the feed conduit 31 is directed towards the inner side of the cylinder casing 26, with the distance between this outlet 33 and the inner side of the cylinder floor 23 being smaller than the distance between this outlet 33 and the opening 25 of the hollow cylinder 21.

The distance between the outlet 33 of the feed conduit 31 and the inner side of the cylinder floor 23 is preferably in a range of from about 1 to about 20 millimeters.

In a preferred embodiment, the cylindrical side wall 35 of the feed conduit 31 has, in addition to the aforementioned outlet 33, several openings, with all of these openings being arranged in the axial direction between its inlet 32 and its outlet 33. These openings provide fluid communication between the interior chamber 21 and the interior 4 of the feed conduit 31.

The following types of processes may be carried out using a device according to the present invention. In these processes, all circular hole-type nozzles in the casing of the hollow cylinder 11 or 21 are filled completely with the liquid. The liquid throughput through the hollow cylinder is adjusted such that the liquid flows through the circular hole-type nozzles with a flow rate in the range of from about 0.1 to about 2.0 m/s, preferably from about 0.3 to about 1.0 m/s.

A method for atomizing a liquid in which the liquid is atomized by means of one of the devices as described above.

A method for spray cooling of a liquid in which the liquid is atomized by means of one of the devices as described above, with the hollow cylinder 11 or 21 being arranged in a gas stream, e.g., in a stream of air with an air temperature in the range of from about 5° to about 50° C. Other gases, e.g., nitrogen, can be used instead of air.

A method for spray cooling of a liquid in which the liquid is atomized by means of one of the devices as described above, with the spraying being carried out in an indirectly tempered room in which the room temperature is in the range of from about 5° to about 50° C.

A method for spray drying of a liquid in which the liquid is atomized by means of one of the devices as described above, with the hollow cylinder 11 or 21 being arranged in a gas stream with a gas temperature being in a range of from about 140° to about 300° C.

A method for spray drying of a liquid in which the liquid is atomized by means of one of the devices as described above, with the spraying carried out in an indirectly tempered room in which the room temperature is in the range of from about 140° to about 300° C.

Figure 11:
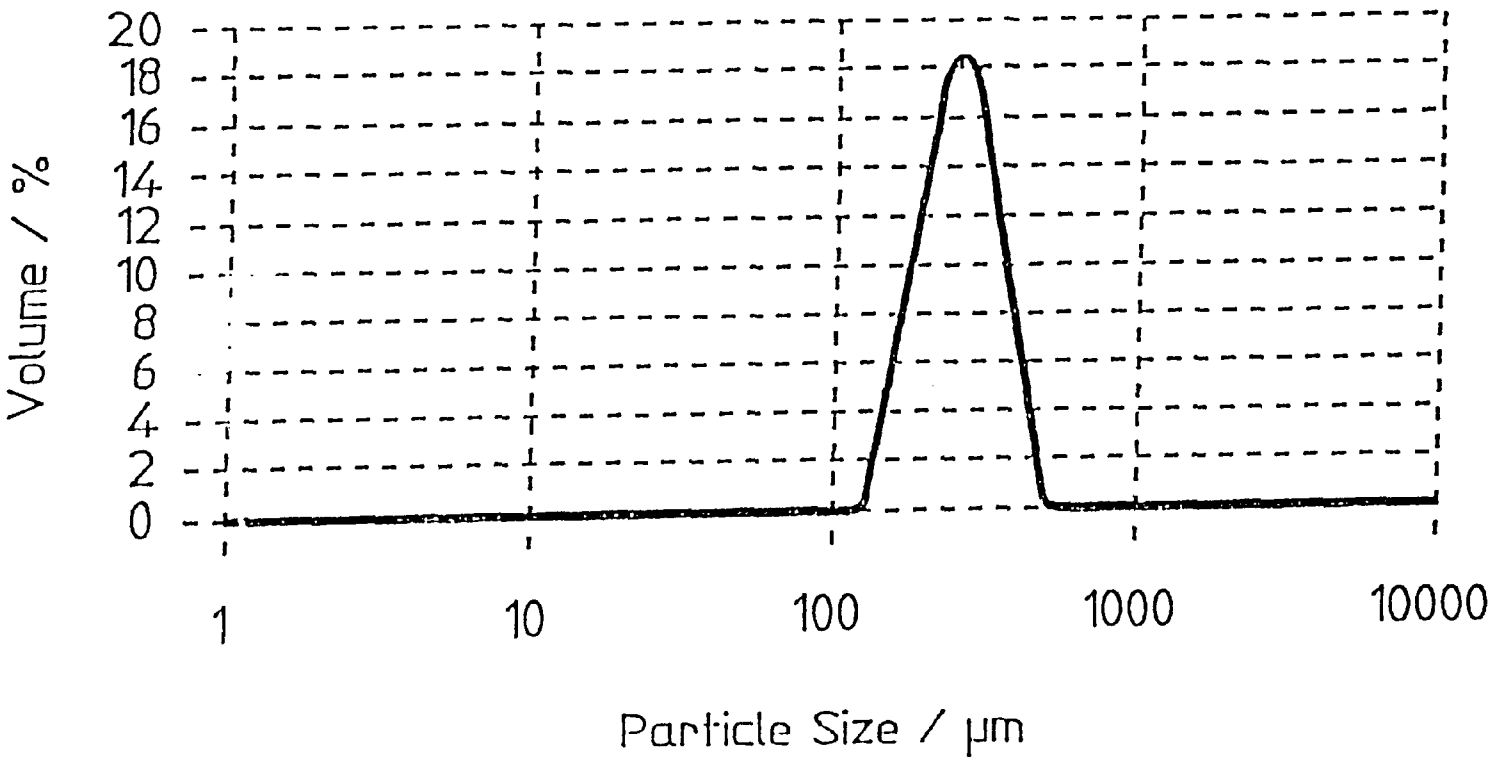
FIG. 11 shows a diagram from which the narrow particle size distribution, presented as volume distribution, achieved with a device of the present invention is evident.

The narrow particle size distribution which is achieved with the devices in accordance with the present invention is presented as a volume distribution in the diagram in accordance with FIG. 11.

The following examples are provided to further illustrate device and methods of the present invention. These examples are illustrative only and are not intended to limit the scope of the invention in any way.

EXAMPLES

Example 1

The atomization procedure that can be carried out with the devices in accordance with the present invention described above can be used on a large scale for the production of powders from solutions, dispersions, preferably emulsions, as well as from melts.

Figure 10:
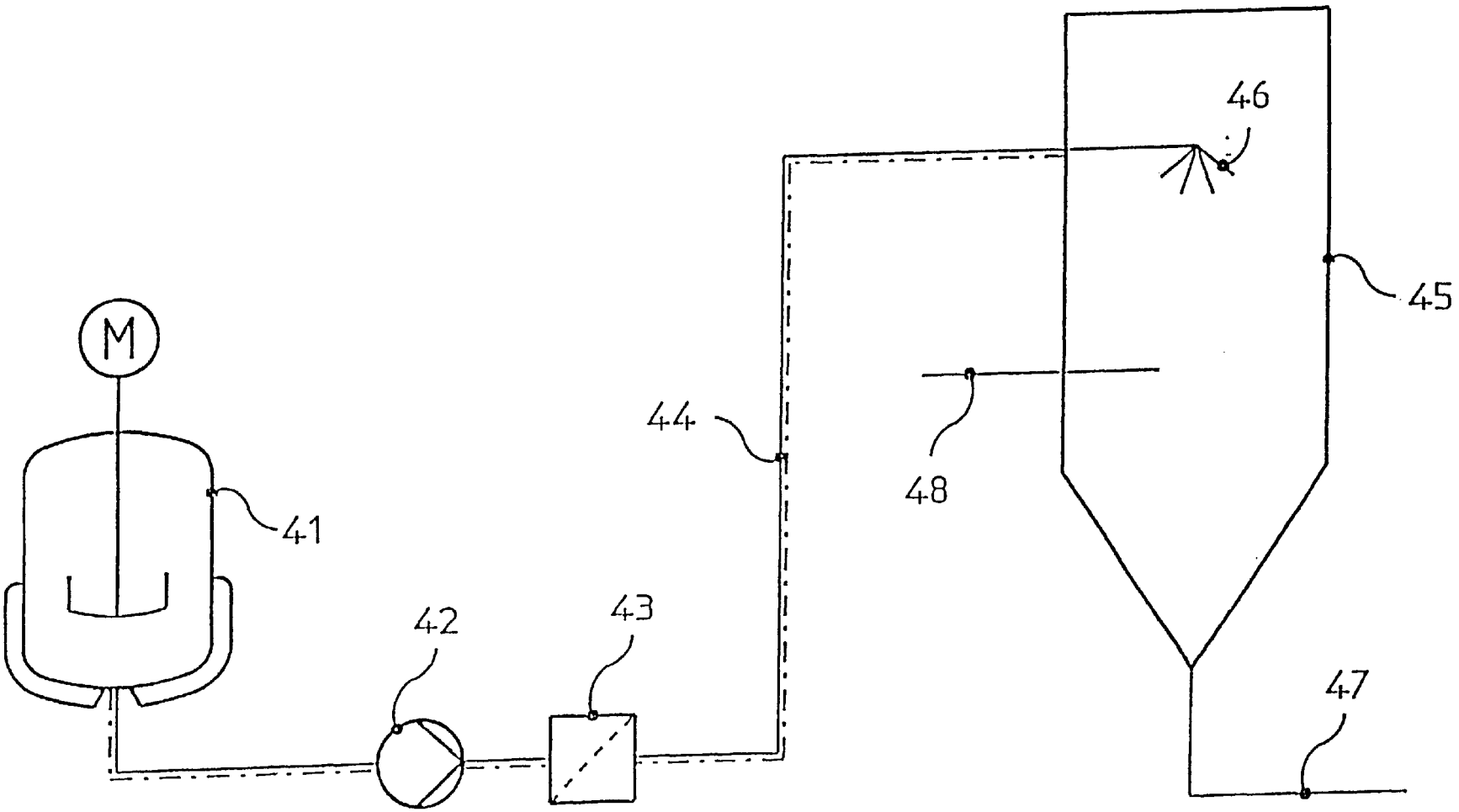
FIG. 10 shows a schematic representation of an arrangement in which a device according to the present invention is used for the production of powders from solutions, dispersions, emulsions, and melts.

An example for the construction of the device required for this is presented schematically in FIG. 10. This construction comprises a stock container 41, a feed pump 42, a filter 43, a temperature-conditioned feed conduit 44, a spray container 45, a spray arrangement 46, a product discharge conduit 47, which are in fluid communication with each other, and optionally a supply conduit 48 for additives required, such as, e.g., silicic acid, starch, cold/warm air, or other additives. In this construction, the filter is upstream of the spray arrangement.

The mesh size of the filter 43 is selected as a function of the diameter of the hole of the circular hole-type nozzles 18 or 28. A filter 43 with a mesh size in a range of from about 50 to about 1000 micrometers is, e.g., selected for hole diameters in a range of from about 0.05 to about 1 millimeter. A filter 43 with a mesh size in a range of from about 100 to about 400 micrometers is selected for hole diameters in a range of from about 0.1 to about 0.4 millimeter.

Example 2

Production of an Active Substance Powder in a Gelatin Matrix

An aqueous active substance (e.g., vitamin E emulsion) is stored in the stock container 41 at about 60° C.

The emulsion with a dry substance content of about 45–50% is conveyed via the feed pump 42 through the filter 43 with a typical mesh size of about 100 to about 300 micrometers to the spray arrangement 46.

The emulsion in the spray container 45 is atomized via the described spray arrangement 46 (containing the device in accordance with the present invention, see e.g., FIGS. 1–9). The environmental temperature in the spray container 45 is about 20° C. The required additives 8 are simultaneously dosed into the spray container 45.

The spraying is carried out with the spray arrangement 46, which has the following features:

Circular hole diameter DB=0.3 millimeter,

Number of circular hole-type nozzles=1000

Cylinder wall thickness s=1 millimeter

Diameter of the hollow cylinder DC=25 millimeters

Nozzle rotation n=7,000 revolutions/minute

Emulsion throughput: 150 kg/hour.

A powder with an average particle size of about 200 to about 250 micrometers is obtained at the outlet 47 of the spray container 45.

The invention being thus described, it will be obvious that the same may be varied in many ways. Such variations are not to be regarded as a departure from the spirit and scope of the invention and all such modifications are intended to be included within the scope of the following claims.

What is claimed is:

1. A device for atomizing liquids comprising:

a) a rotatable apparatus for the reception of liquids to be atomized, the apparatus is defined by a cylinder having an interior chamber that runs the length of the cylinder with an internal diameter of about 10 to about 25 millimeters, the cylinder has an upper end with an opening into the interior chamber, which opening is adapted to receive liquids to be atomized, the cylinder has a closed lower end that terminates with a floor, the outer surface of the cylinder is defined by an outer casing having a plurality of circular hole-type nozzles extending up about 20 to about 120 millimeters from the lower end of the cylinder in an axial direction, the hole-type nozzles are in fluid communication with the interior chamber for introducing the liquid to be atomized into the nozzles;

b) a drive operably connected to the cylinder for rotating the hollow cylinder; and c) a co-rotating hollow shaft that is removably attached to the cylinder at its upper end and through which liquids are introduced into the interior chamber of the cylinder through the opening.

2. A device according to claim 1 wherein the cylinder is screw-mounted on the co-rotating hollow shaft.

3. A device according to claim 1 wherein each of the circular hole-type nozzles has a hole diameter of about 0.05 to about 1 millimeter.

4. A device according to claim 3 further comprising a filter operably connected to the device upstream of the cylinder wherein the filter has a mesh size that is sufficient to pass particles with a diameter from about 50 to about 1000 micrometers to the cylinder.

5. A device according to claim 1 wherein the circular hole-type nozzles in the casing have a hole diameter of from about 0.1 to about 0.4 millimeter.

6. A device according to claim 5 further comprising a filter operably connected to the device upstream of the cylinder wherein the filter has a mesh size that is sufficient to pass particles with a diameter from about 100 to about 400 micrometers.

7. A device according to claim 1 wherein the circular hole-type nozzles have a length/hole diameter ratio in the range of from about 1 to about 50.

8. A device according to claim 1 wherein the circular hole-type nozzles have a length/hole diameter ratio in the range of from about 2 to about 10.

9. A device according to claim 1 wherein the drive rotates the cylinder at from about 2,000 to about 20,000 revolutions per minute.

10. A device according to claim 9 wherein the drive rotates the cylinder at from about 3,000 to about 10,000 revolutions per minute.

11. A device for atomizing liquids comprising:

a) a rotatable apparatus for the reception of liquids to be atomized, the apparatus is defined by a cylinder having an interior chamber that runs the length of the cylinder, the cylinder has an upper end with an opening into the interior chamber, which opening is adapted to receive liquids to be atomized, the cylinder has a closed lower end that terminates with a floor, the outer surface of the cylinder is defined by an outer casing having a plurality of circular hole-type nozzles, the hole-type nozzles are in fluid communication with the interior chamber introducing the liquid to be atomized into the nozzles;

b) a feed conduit having an outer side wall surface and an inner conduit surface, the feed conduit adapted to be disposed within the interior chamber of the cylinder along an axis of rotation of the cylinder, the feed conduit having (a) an upper end with an inlet through which liquids to be atomized are introduced into the interior chamber of the cylinder, the inlet being attached to the opening of the hollow cylinder and thereby to the source of the liquid to be atomized, and (b) a lower end with an outlet for the atomized liquid wherein the inlet and the outlet are in fluid communication, the lower end of the feed conduit disposed within the interior chamber such that the distance between the outlet and the interior chamber floor is less than the distance between the outlet and the opening to the interior chamber; and c) a drive operably connected to the cylinder for rotating the hollow cylinder.

12. A device according to claim 11 wherein the distance between the outlet of the feed conduit and the interior chamber floor is from about 1 to about 20 millimeters.

13. A device according to claim 11 further comprising a plurality of openings disposed on an outer side wall surface of the feed conduit, which openings are arranged in an axial direction between the inlet and the outlet of the feed conduit, and which openings are in fluid communication with the interior of the conduit.

14. A device according to claim 11 wherein a) the diameter of the interior chamber is about 10 to about 60 millimeters; and b) the circular hole-type nozzles are disposed on an area of the outer casing extending up about 20 to about 120 millimeters from the lower end of the cylinder in an axial direction.

15. A device according to claim 11 wherein a) the diameter of the interior chamber is about 20 to about 40 millimeters; and b) the circular hole-type nozzles are disposed on an area of the outer casing extending up about 120 to about 250 millimeters from the lower end of the cylinder in an axial direction.

16. A device according to claim 11 further comprising a co-rotating hollow shaft that is removably attached to the cylinder at its upper end and through which liquids are introduced into the interior chamber of the cylinder through the opening.

17. A device according to claim 16 wherein the cylinder is screw-mounted on the co-rotating hollow shaft.

18. A device according to claim 11 wherein each of the circular hole-type nozzles has a hole diameter of about 0.05 to about 1 millimeter.

19. A device according to claim 18 further comprising a filter operably connected to the device upstream of the cylinder wherein the filter has a mesh size that is sufficient to pass particles with a diameter from about 50 to about 1000 micrometers to the cylinder.

20. A device according to claim 11 wherein the circular hole-type nozzles in the casing have a hole diameter of from about 0.1 to about 0.4 millimeter.

21. A device according to claim 20 further comprising a filter operably connected to the device upstream of the cylinder wherein the filter has a mesh size that is sufficient to pass particles with a diameter from about 100 to about 400 micrometers.

22. A device according to claim 11 wherein the circular hole-type nozzles have a length/hole diameter ratio in the range of from about 1 to about 50.

23. A device according to claim 22 wherein the circular hole-type nozzles have a length/hole diameter ratio in the range of from about 2 to about 10.

24. A device according to claim 11 wherein the drive rotates the cylinder at from about 2,000 to about 20,000 revolutions per minute.

25. A device according to claim 24 wherein the drive rotates the cylinder at from about 3,000 to about 10,000 revolutions per minute.

26. A method for atomizing a liquid comprising:

a) introducing a liquid into a device according to one of claims 1–25;

b) generating a laminar thread-like disintegration by droplet dispersion in the device; and c) controlling the viscosity of the liquid to be atomized, speed of rotation of the cylinder, and the diameter of the inner chamber of the cylinder to achieve an average droplet size during spraying of from 100 to 350 micrometers.

27. A method for spray cooling or spray drying of a liquid comprising:

a) introducing the liquid into a device comprising:

i) a rotatable apparatus for the reception of liquids to be atomized, the apparatus is defined by a cylinder having an interior chamber that runs the length of the cylinder with an internal diameter of about 10 to about 25 millimeters, the cylinder has an upper end with an opening into the interior chamber, which opening is adapted to receive liquids to be atomized, the cylinder has a closed lower end that terminates with a floor, the outer surface of the cylinder is defined by an outer casing having a plurality of circular hole-type nozzles extending up about 20 to about 120 millimeters from the lower end of the cylinder in an axial direction, the hole-type nozzles are in fluid communication with the interior chamber for introducing the liquid to be atomized into the nozzles, ii) a drive operably connected to the cylinder for rotating the hollow cylinder, and iii) a co-rotating hollow shaft that is removably attached to the cylinder at its upper end and through which liquids are introduced into the interior chamber of the cylinder through the opening; and b) spraying the liquid through the nozzles by rotating the cylinder and causing the liquid to be atomized.

28. A method according to claim 27 wherein the cylinder is disposed within a gas stream with a gas temperature in the range of from about 5° to about 50° C.

29. A method according to claim 27 wherein the spraying is carried out in an indirectly tempered room in which the room temperature is in the range of from about 5° to about 50° C.

30. A method according to claim 27 wherein the cylinder is disposed within a gas stream with a gas temperature in the range of about 140° to about 300° C.

31. A method according to claim 27 wherein the spraying is carried out in an indirectly tempered room in which the room temperature is in the range of from about 140° to about 300° C.

32. A method according to claim 27 further comprising introducing the liquid into the interior chamber of the cylinder at a pressure of from about 0.3 to about 5 bar.

33. A method according to claim 27 further comprising controlling the viscosity of the liquid to be atomized, the throughput of the liquid, the speed of rotation of the cylinder, the diameter of the interior chamber of the cylinder, and the diameter of the holes in the hole-type nozzles to achieve an average droplet size during the spraying of from about 50 to about 500 micrometers.

34. A method according to 33 wherein the average droplet size during the spraying is from about 100 to about 350 micrometers.

35. A method according to 33 wherein the flow rate of the liquid flowing through the circular hole-type nozzles is in the range of from about 0.1 to about 2.0 m/s.

36. A method according to claim 35 wherein the flow rate of the liquid through the hole-type nozzles is in the range of from about 0.3 to about 1.0 m/s.

37. A method for spray cooling or spray drying of a liquid comprising:

a) introducing the liquid into a device comprising:

i) a rotatable apparatus for the reception of liquids to be atomized, the apparatus is defined by a cylinder having an interior chamber that runs the length of the cylinder, the cylinder has an upper end with an opening into the interior chamber, which opening is adapted to receive liquids to be atomized, the cylinder has a closed lower end that terminates with a floor, the outer surface of the cylinder is defined by an outer casing having a plurality of circular hole-type nozzles, the hole-type nozzles are in fluid communication with the interior chamber for introducing the liquid to be atomized into the nozzles, ii) a feed conduit having an outer side wall surface and an inner conduit surface, the feed conduit adapted to be disposed within the interior chamber of the cylinder along an axis of rotation of the cylinder, the feed conduit having (a) an upper end with an inlet through which liquids to be atomized are introduced into the interior chamber of the cylinder, the inlet being attached to the opening of the hollow cylinder and thereby to the source of the liquid to be atomized, and (b) a lower end with an outlet for the atomized liquid wherein the inlet and the outlet are in fluid communication, the lower end of the feed conduit disposed within the interior chamber such that the distance between the outlet and the interior chamber floor is less than the distance between the outlet and the opening to the interior chamber, and iii) a drive operably connected to the cylinder for rotating the hollow cylinder; and b) spraying the liquid through the nozzles by rotating the cylinder and causing the liquid to be atomized.

38. A method according to 37 further comprising positioning the cylinder within a gas stream with a gas temperature in the range of from about 5° to about 50° C.

39. A method according to 37 further comprising spraying the liquid in an indirectly tempered room in which the room temperature is in the range of from about 5° to about 50° C.

40. A method according to 37 further comprising positioning the cylinder within a gas stream with a gas temperature in the range of about 140° to about 300° C.

41. A method according to 37 further comprising spraying the liquid in an indirectly tempered room in which the room temperature is in the range of from about 140° to about 300° C.

42. A method according to 37 further comprising introducing the liquid into the interior chamber of the cylinder at a pressure of from about 0.3 to about 5 bar.

43. A method according to 37 further comprising controlling the viscosity of the liquid to be atomized, the throughput of the liquid, the speed of rotation of the cylinder, the diameter of the interior chamber of the cylinder, and the diameter of the holes in the hole-type nozzles to achieve an average droplet size during the spraying of from about 50 to about 500 micrometers.

44. A method according to claim 43 wherein the average droplet size during the spraying is from about 100 to about 350 micrometers.

45. A method according to claim 43 wherein the flow rate of the liquid flowing through the circular hole-type nozzles is in the range of from about 0.1 to about 2.0 m/s.

46. A method according to claim 45 wherein the flow rate of the liquid through the hole-type nozzles is in the range of from about 0.3 to about 1.0 m/s.

47. A method of producing powders from solutions, dispersions, emulsions, or melts comprising:

a) introducing a solution, dispersion, emulsion, or melt into a device comprising:

i) a rotatable apparatus for the reception of the solution, dispersion, emulsion, or melt to be atomized, the apparatus is defined by a cylinder having an interior chamber that runs the length of the cylinder with an internal diameter of about 10 to about 25 millimeters, the cylinder has an upper end with an opening into the interior chamber, which opening is adapted to receive the solution, dispersion, emulsion, or melt to be atomized, the cylinder has a closed lower end that terminates with a floor, the outer surface of the cylinder is defined by an outer casing having a plurality of circular hole-type nozzles extending up about 20 to about 120 millimeters from the lower end of the cylinder in an axial direction, the hole-type nozzles are in fluid communication with the interior chamber for introducing the solution, dispersion, emulsion, or melt to be atomized into the nozzles, ii) a drive operably connected to the cylinder for rotating the hollow cylinder, and iii) a co-rotating hollow shaft that is removably attached to the cylinder at its upper end and through which the solution, dispersion, emulsion, or melt is introduced into the interior chamber of the cylinder through the opening; and b) rotating the cylinder to atomize the solution, dispersion, emulsion, or melt.

* * * * *

UNITED STATES PATENT AND TRADEMARK OFFICE

CERTIFICATE OF CORRECTION

PATENT NO. : 6,651,898 B2 
DATED : November 25, 2003
INVENTOR(S) : Markus Nowotny and Goidp Schaer It is certified that error appears in the above-identified patent and that said Letters Patent is hereby corrected as shown below:

Column 13,
Lines 11 and 14, please insert the word -- claim -- before 33;
Lines 55 and 58, please insert the word -- claim -- before 37.

Column 14,
Lines 1, 4, 8, and 11, please insert the word -- claim -- before 37.

Signed and Sealed this

First Day of February, 2005

JON W. DUDAS
*Director of the United States Patent and Trademark Office*